US006401627B1

(12) United States Patent
Fehrenbach et al.

(10) Patent No.: US 6,401,627 B1
(45) Date of Patent: Jun. 11, 2002

(54) ADJUSTABLE BOGIE WITH THREE WHEEL SETS FOR A RAIL VEHICLE

(75) Inventors: Christophe Fehrenbach, Winterthur; Bruno Meier, Zurich, both of (CH)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/559,652

(22) Filed: Apr. 28, 2000

(30) Foreign Application Priority Data

Apr. 28, 1999 (DE) ..... 199 19 208

(51) Int. Cl.[7] ..... B61F 3/06; B61F 5/02

(52) U.S. Cl. ..... 105/182.1; 105/174; 105/175.1; 105/196

(58) Field of Search ..... 105/166, 174, 105/175.1, 182.1, 183, 188, 196

(56) References Cited

U.S. PATENT DOCUMENTS

| | | | | |
|---|---|---|---|---|
| 3,447,483 A | * | 6/1969 | Lich | 105/136 |
| 4,040,361 A | | 8/1977 | Jackson | |
| 4,088,080 A | | 5/1978 | Jackson | |
| 4,164,188 A | * | 8/1979 | Hallam et al. | 105/166 |
| 4,167,906 A | * | 9/1979 | Steinmann et al. | 105/168 |
| 4,679,506 A | | 7/1987 | Goding et al. | |
| 4,679,507 A | | 7/1987 | Rassaian | |
| 4,787,318 A | | 11/1988 | Vogel | |
| 5,119,736 A | * | 6/1992 | Chiodi | 105/158.2 |
| 5,263,420 A | * | 11/1993 | Schwendt et al. | 105/166 |
| 5,555,816 A | * | 9/1996 | Jones | 105/168 |
| 5,613,444 A | * | 3/1997 | Ahmadian et al. | 105/166 |

FOREIGN PATENT DOCUMENTS

| | | |
|---|---|---|
| CH | 670 228 A5 | 5/1989 |
| DE | 1 159 491 | 12/1963 |
| DE | 1 163 889 | 2/1964 |
| DE | 1 212 579 | 3/1966 |
| DE | 14 55 112 | 3/1969 |
| DE | 16 05 067 | 2/1971 |
| DE | 32 18 399 | 11/1984 |
| DE | 41 40 126 A1 | 6/1993 |
| EP | 0 094 548 A2 | 11/1983 |

* cited by examiner

*Primary Examiner*—Joseph D. Pape
*Assistant Examiner*—Greg Blankenship
(74) *Attorney, Agent, or Firm*—Burns, Doane, Swecker & Mathis, L.L.P.

(57) ABSTRACT

A bogie with three wheel sets for a rail vehicle is described, in which the bogie has two end wheel sets (3) which are connected to a bogie frame (2) at their drive units by in each case at least one slanted link (1), and a center wheel set (12) is connected to the bogie frame by at least one longitudinal link (4) guided parallel to the longitudinal direction of the bogie frame (2). The end wheel sets (3), by in each case at least one transverse link **(5*a, b*) and by a drive-unit extension arm (13) arranged in operative connection with the transverse link (5*a, b*), are connected to the drive unit of the center wheel set (12) in such a way that, during a transverse movement of the center wheel set (12), the end wheel sets (3) are coupled with the latter and that, during a turn-out movement of the end wheel sets (3), the latter are coupled in opposite directions. Furthermore, the drive units in each case have at least one brake device (8), each of these brake devices (8) being arranged directly on the motor (6) or on the gear case (11) and acting on at least one wheel disc (10) of the associated wheel set (3, 12)**.

10 Claims, 5 Drawing Sheets

ADJUSTABLE BOGIE WITH THREE WHEEL SETS FOR A RAIL VEHICLE

FIELD OF THE INVENTION

This invention relates to rail vehicles, and more specifically to three wheel sets arranged in a bogie frame for supporting a rail vehicle.

BACKGROUND OF THE INVENTION

Bogies for modern rail vehicles must often be designed to cope with high curve speeds in mostly sharp curves. An adjustable two-axle bogie, as described in CH 670 228 A5, is known for this purpose. In this two-axle bogie, the wheel sets, when negotiating curves, are in each case adjusted independently, without control input, in particular without additional adjusting devices, essentially radially to the curve to be negotiated. In this case, the wheel sets are arranged on the bogie frame via the motor by means of slanted links in such a way that a rotary movement about a vertical axis about the center of the wheel set, even with traction forces being exerted on the bogie, is possible.

Furthermore, DE 41 40 126 A1 discloses a three-axle bogie which has a radial control for the radial deflection of the wheel sets of the bogie. In this case, the wheel sets are mounted on the bogie frame in an elastic manner, the radial deflection of the wheel sets being made possible by means of steering linkages, longitudinal links, steering rods, coupling rods and bell-crank levers with arms arranged thereon.

In this three-axle bogie, the radial adjustment of the wheel sets is certainly possible, but, due to the large wheel base and as a result of permitting the radial adjustment of the wheel sets at the same time, a large number of parts, which are arranged or fitted in a complex manner, are necessary. As a result, the manufacturing costs of such a bogie increase to an intolerable extent. In addition, the maintenance of this large number of parts proves to be too costly.

Neither CH 670 228 A5 nor DE 41 40 126 A1 provides a solution for a bogie, in particular for three-axle applications required nowadays, which is cost-effective and comprehensive in terms of maintenance.

Conventional brake devices for three-axle bogies are firmly connected to the bogie frame. Such a brake device fixed to the bogie frame and acting on the respective wheel discs poses a problem with regard to its mounting on the bogie frame, since the transverse deflection and longitudinal deflection between the respective brake device and the associated wheel disc is too large in order to act on the wheel disc in an appropriate manner. Although a transversely elastic suspension of the brake device or a transverse guidance of the brake device is conceivable, it complicates the bogie construction and increases the component and maintenance costs considerably, so that a brake device fixed to the bogie frame is not suitable for a cost-effective three-axle bogie.

BRIEF SUMMARY OF THE INVENTION

The object of the invention is therefore to provide an adjustable bogie with three wheel sets for a rail vehicle, which bogie permits a radial adjustment of the wheel sets, in particular even under the effect of traction force and braking force on the bogie, without control input, in particular without additional adjusting devices to be actuated, and in which the number of parts is reduced and thus an exceptionally simple construction of the bogie is possible.

This object is achieved, according to this invention by an adjustable bogie for a rail vehicle having three wheel sets.

Two end wheel sets of the bogie are connected to the bogie frame at their drive devices by in each case at least one slanted link, and a center wheel set is connected to the bogie frame by at least one longitudinal link guided parallel to the longitudinal direction of the bogie frame. Due to such a coupling between the center wheel set and the bogie frame, this center wheel set can only perform a transverse movement, as a result of which conventional coupling rods are advantageously dispensed with. Furthermore, the traction and braking force can be transmitted via the center wheel set, in particular via the drive device of the center wheel set. The wheel sets of the bogie can therefore be adjusted radially in an especially simple manner.

A further design of the bogie according to the invention provides for the end wheel sets, via in each case at least one transverse link and via a drive-unit extension arm arranged in operative connection with the transverse link, to be connected to the drive unit of the center wheel set in such a way that, during a transverse movement of the center wheel set, the end wheel sets are coupled with the latter and that, during a turn-out movement of the end wheel sets, the latter are coupled in opposite directions. The radial adjustment of the wheel sets is further assisted by this design of the bogie according to the invention and can be carried out speedily.

In addition, the drive unit of each wheel set comprises at least one brake device which is arranged directly on the motor or on the gear case and acts on at least one wheel disc of the associated wheel set. As a result, a complicated mounting, which is costly and requires considerable maintenance, of the brake device on the bogie frame is dispensed with in an exceptionally advantageous manner, and the brake device may be mounted very simply directly on the drive device, in which case it follows every movement of the wheel sets.

BRIEF DESCRIPTION OF THE DRAWINGS

The invention is illustrated in the accompanying drawings, in which.

DETAILED DESCRIPTION OF THE INVENTION

Figure 1:
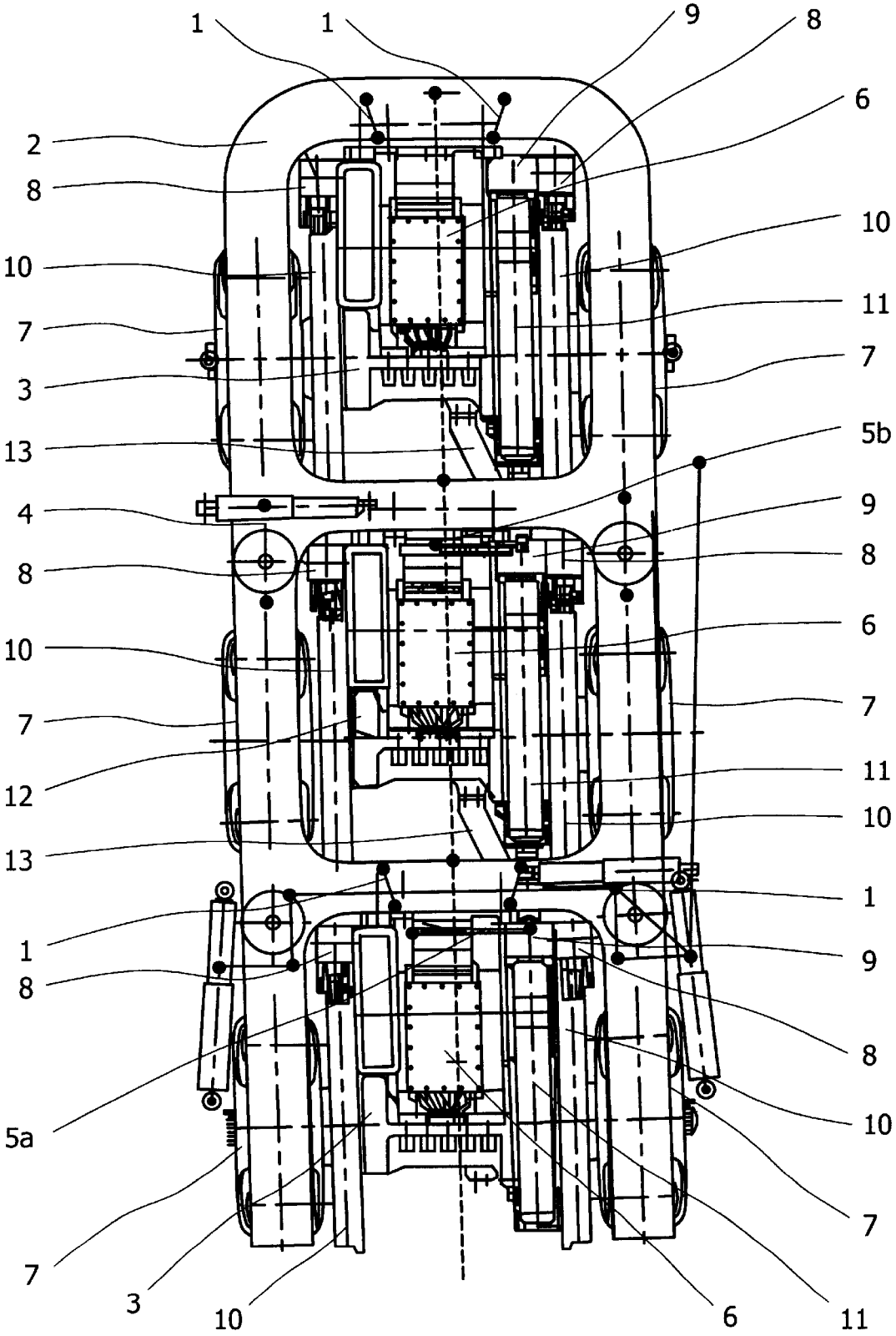
FIG. 1 is a plan view of an adjustable bogie with three wheel sets for a rail vehicle in accordance with this invention.

Referring to FIG. 1, a bogie in accordance with the invention has three wheel sets for a rail vehicle. The wheel sets of the bogie are formed therein in a conventional manner by two end wheel sets 3 and a center wheel set 12. The two end wheel sets 3 and the center wheel set 12 are arranged in a bogie frame 2. The bogie frame 2 extends across in front of the end wheel set 3 and the rear end of the bogie frame is open. The two end wheel sets 3 can be turned outwards relative to the longitudinal direction of the bogie frame 2, i.e., they can perform a turn-out movement and can therefore be radially adjusted by a curved track when negotiating curves. Each wheel set 3, 12 comprises a drive unit, which has a motor 6 and a gear case 11 with gearing arranged therein. As shown in FIG. 1, the two end wheel sets 3, according to the invention, are connected to the bogie frame 2 at their drive units by a pair of slanted links 1. In addition, the center wheel set 12 is connected to the bogie frame 2 by at least one longitudinal link 4 guided parallel to the longitudinal direction of the bogie frame 2. This arrangement of the longitudinal link 4 and the slanted links 1 enables conventional coupling rods to be dispensed with.

Figure 3:
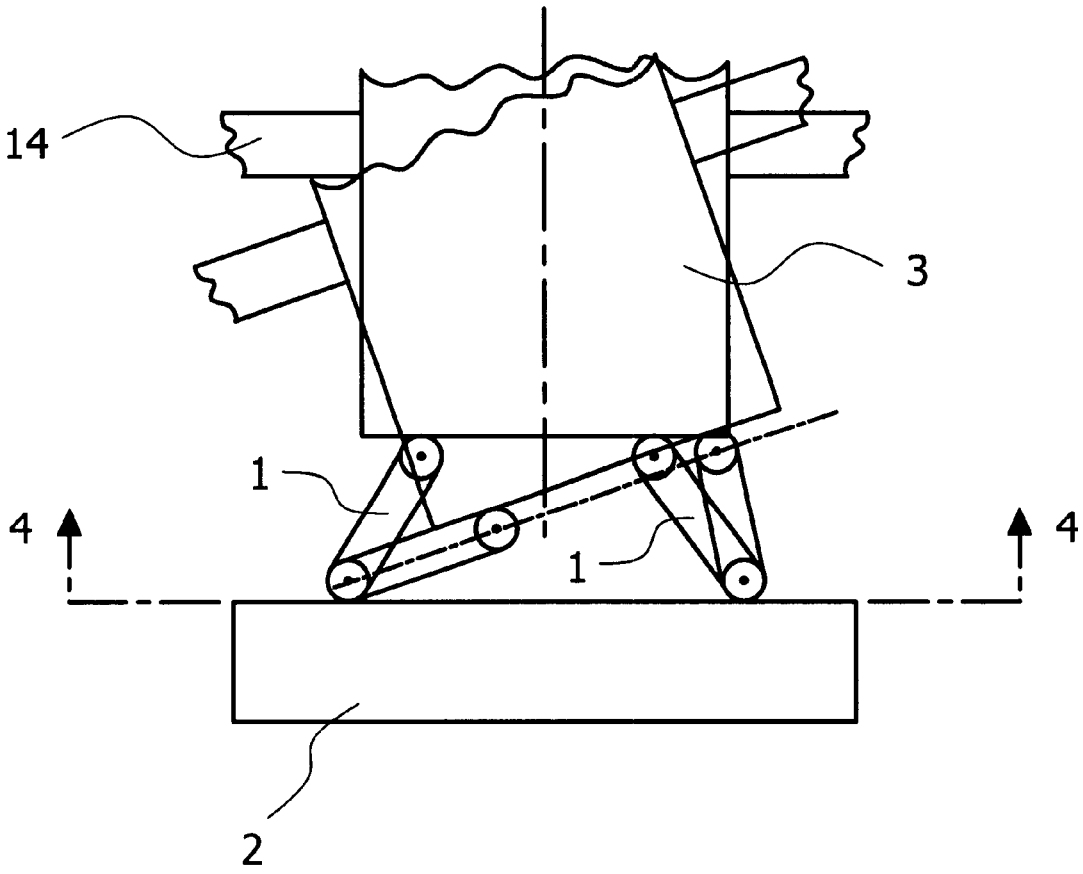
FIG. 3 is a top plan view, partially schematic, of the front end wheel set with slanted links.
Figure 4:
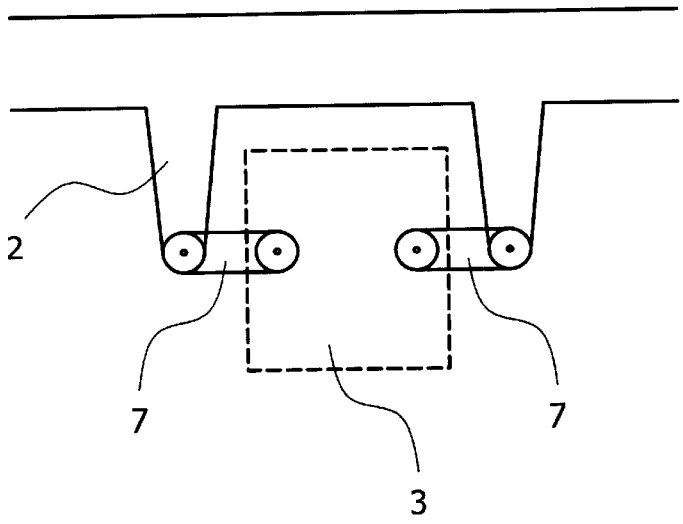
FIG. 4 is a cross-sectional view of the slanted links arrangement along the line 4—4 in FIG. 3.
Figure 7:
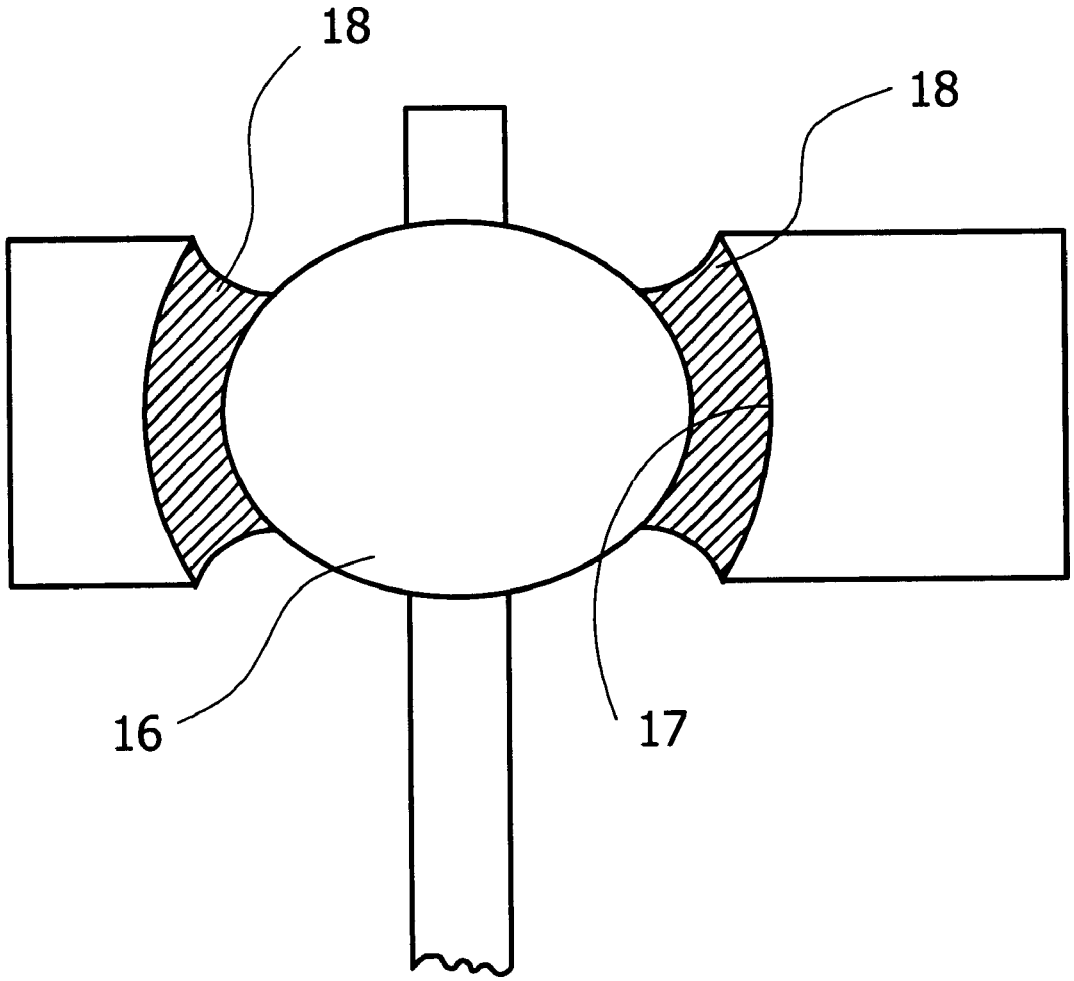
FIG. 7 is a schematic view of the three dimensional mounting arrangement of the transverse link.

The arrangement of the slanted links 1 is shown in FIGS. 3 and 4. The front portion of the bogie frame 2 has a pair of slanted links 1 which extend between the bogie frame 2 and the drive motor 6 of the front wheel set 3. The axle for the front wheel set 3 has wheel discs 10 which engage the tracks. The axles 14 for each of the wheel sets are journalled in bearings that fix the axles in the vertical direction and in the transverse to the longitudinal direction without any suspension. The slanted links 1 are positioned relative to the wheel set 3 in a manner such that the longitudinal axis of the respective links 1 intersect at the central axis of the axle 14. The links 1 have at each end a three dimensional mounting, as shown in FIG. 7. The end portion of the link has a ball 16 which is received in a socket 17 which permits pivoting movement of the link in all three dimensions. Preferably, a cushion material 18 such as rubber or plastic serves as a cushion for the ball. When the wheel set enters a curve, which in FIG. 3 would be a curve to the left, the links 1 each swing in a clockwise direction which allows the wheels of the axle 14 to follow the curvature of the track.

On account of this coupling, the center wheel set 12 only performs a transverse movement. Consequently, the center wheel set 12 and in particular its drive unit constitute a coupling member between the end wheel sets 3, by which coupling member traction and braking force can be transmitted. In this arrangement, the wheel sets 3, 12 are radially adjustable, in which case, as mentioned at the beginning, the two end wheel sets 3 can be turned outwards and the center wheel set 12 can perform a transverse movement.

Figure 5:
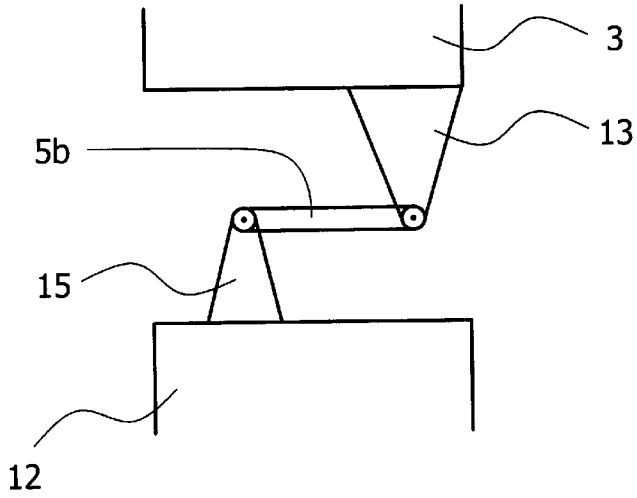
FIG. 5 is a top plan view, partially schematic, of the connection between the center wheel set and the front end wheel set.

The front wheel set 3 is connected to the center wheel set 12 by a transverse bar or link 5*b*, as shown in FIG. 5 and by an extension arm 13 which is connected to the drive unit. The opposite end of the transverse link 5*b* is pivotally mounted on the center wheel set 12 by a bracket 15. The ends of the link 5*b* have a three dimensional mounting, as shown in FIG. 7.

Figure 6:
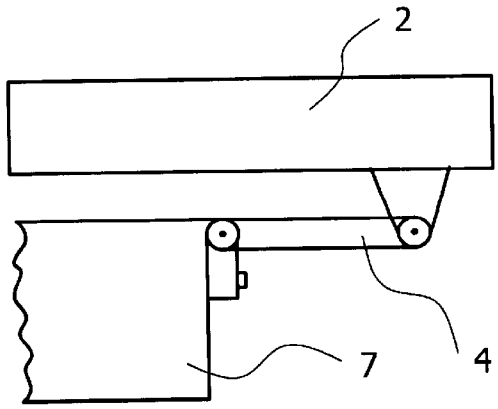
FIG. 6 is a side elevational view showing the arrangement for the longitudinal link between the bogie frame and the center wheel set.

As shown in FIG. 6, the center wheel set 12 is secured to the bogie frame 2 by a longitudinal link 4. One end of the link 4 is mounted on the axle bearing device 7 of the wheel set 12 and the opposite end of the link 4 is mounted on a bracket on the bogie frame 2. As shown in FIG. 7, each end of the transverse link 4 has a three dimensional mounting.

The end wheel set 3 at the rear end of the bogie frame is also mounted on slanted links 1, as shown in FIGS. 1 and 4, and as described with respect to the front wheel set 3. A drive unit extension arm of the center wheel set corresponds to the extension arm 13, as described above with respect to the connection between the front wheel set and the center wheel set. A bracket that corresponds to the bracket 15 is mounted on the rear end wheel set axle bearing device and a transverse link 5*a* has its opposite ends mounted on the extension arm and the bracket, as shown in FIGS. 1 and 5. The slanted links 1 at the rear end wheel set are mounted between the bogie frame 2 and the axle bearing device at the front of the wheel set 3, as in FIG. 4. In the same manner as described above, a longitudinal link corresponding to the link 4 is connected between the center wheel set and the bogie frame 2.

These links accommodate a transverse movement of the center wheel set while the end wheel sets are coupled with it and, in addition, during a turn out movement of the end wheel sets in a curve, the end wheel sets are coupled in opposite directions. This arrangement of the bogie according to the invention facilitates the turn out movement of the end wheel sets and the transverse movement of the center wheel set, so that the wheel sets can be especially easily adjusted and that the adjustment takes place speedily.

According to FIG. 1, the connection between front end wheel set 3 and the center wheel set 12 is made in such a way that the transverse link 5*b* is arranged on the drive unit of this end wheel set 3 and is connected to the drive unit of the center wheel set 12 via the drive-unit extension arm 13 arranged in operative connection with the transverse link 5*b*.

Furthermore, a further connection is made between the rear end wheel set 3 and the center wheel set 12 in such a way that the transverse link 5*a* is arranged on the drive unit of this center wheel set 12 and is connected to the drive unit of the rear end wheel set 3 via the drive-unit extension arm 13 arranged on the end wheel set 3 in operative connection with the transverse link 5*a*.

Although not shown in the drawing, a drive-unit extension arm 13 can be arranged in each case on each drive unit of the end wheel sets 3, or for all the drive-unit extension arms 13 to be arranged on the drive unit of the center wheel set 12. Each end wheel set 3, as mentioned at the beginning, is then connected to the drive unit of the center wheel set 12 by the transverse link 5*a*, 5*b* and by the associated drive-unit extension arm 13 arranged in operative connection with the transverse link 5*a*, 5*b*.

Each transverse link 5*a*, 5*b* is mounted in a three-dimensional manner, as shown in FIG. 7, with the drive-unit extension arm 13 arranged in operative connection with it. As a result, forces between transverse link 5*a*, 5*b* and drive-unit extension arm 13 which are necessary for the radial adjustment of the wheel sets can advantageously be transmitted to the bogie even under the effect of traction and braking forces, and also under forces acting spatially on the bogie.

Figure 2:
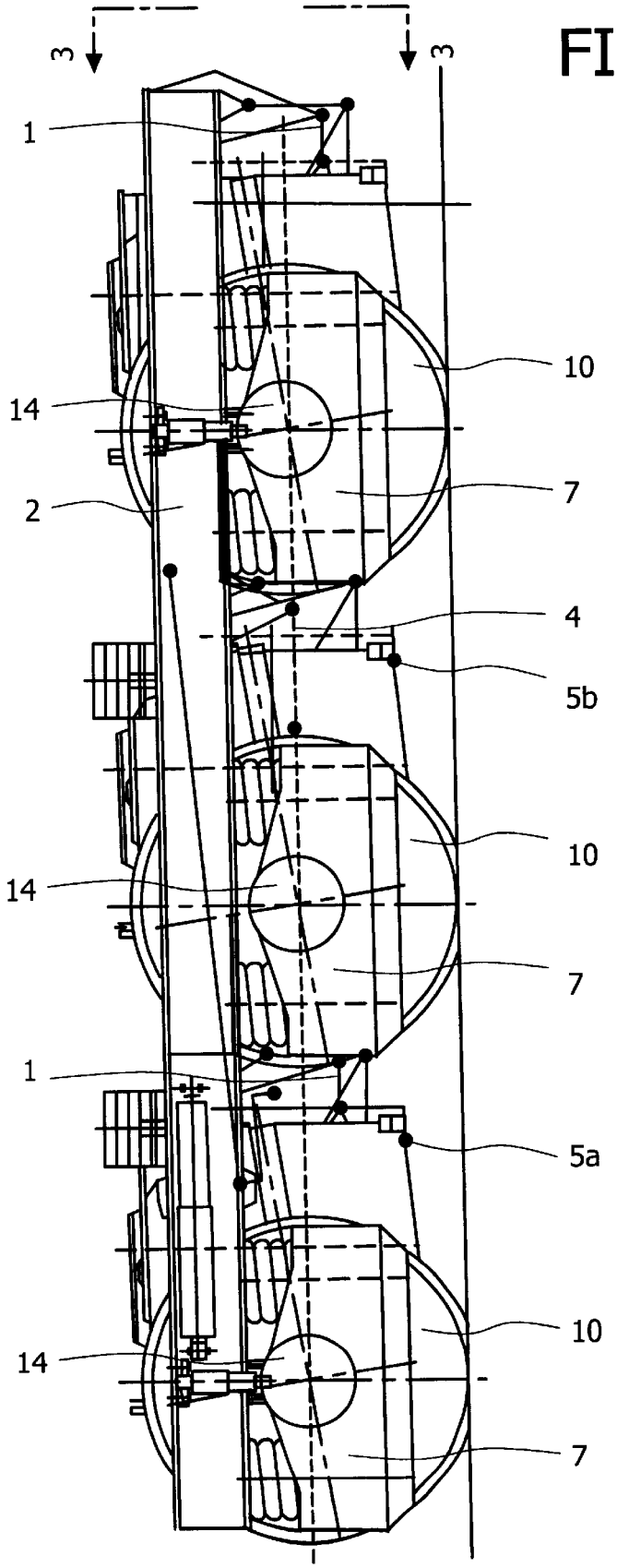
FIG. 2 is a side elevational view of the bogie according to FIG. 1.

According to FIG. 2, all the axles 14 of the drive units of the wheel sets 3, 12 are nose-suspended by means of an axle bearing device 7, so that the axles 14 are supported so as to be advantageously carried vertically and transversely to the longitudinal direction of the bogie frame 2. The nose suspension of the axles 14 of the drive units of the wheel sets 3, 12 enables the axles to take vertical forces and longitudinal forces to adjust the wheel sets.

According to the invention, each drive unit according to FIG. 1 in each case comprises at least one brake device 8, each brake device 8 being arranged directly on the motor 6 or on the gear case 11. In this case, each brake device 8 acts on at least one wheel disc 10 of the associated wheel set 3, 12. Due to this arrangement of the brake device 8, the latter can follow every movement of the associated wheel set 3, 12, as a result of which a complicated mounting, which is also costly and requires considerable maintenance, of a brake device on the bogie frame 2 is dispensed with. Furthermore, it has proved to be very advantageous for the brake device to be arranged on the motor 6 or gear case 11 via a retaining device 9 arranged between the motor 6 and the gear case 11. It is thereby possible to service the brake device 8 in a short time. The brake device 8 is advantageously a brake-block device, since the latter constitutes an exceptionally cost-effective brake device 8 for a three-axle bogie having the large number of wheel discs 10 to be braked. Likewise constituting a very favourable embodiment of the brake device 8 is a wheel-disc brake device which acts directly on the wheel disc 10 of the associated wheel set 3, 12, the wheel disc 10 constituting a brake disc.

What is claimed is:

1. An adjustable bogie with three wheel sets for a rail vehicle comprising a bogie frame, a center wheel set and two end wheel sets mounted in the bogie frame, the center wheel set being mounted between the end wheel sets, each wheel set having a drive unit including an axle fixed against vertical and longitudinal displacement relative to the drive unit, each of the two end wheel sets being connected to the bogie frame by a pair of slanted links between the drive unit and the bogie frame, a first transverse link being mounted between one of the end wheel sets and the center wheel set and a second transverse link being mounted between the other end wheel set and the center wheel set, and longitudinal links extending between the bogie frame and the respective wheel sets, the longitudinal links being parallel to the longitudinal direction of the bogie frame, whereby the links permit the end wheel sets to be turned outward, while the center wheel set is displaced transversely when the bogie is negotiating a curve.

2. The bogie according to claim 1, further comprising:

a drive-unit extension arm arranged in operative connection with the first and second transverse links, the front end wheel set and the rear end wheel set, each having a drive-unit extension arm, each transverse link being mounted with the drive-unit extension arm.

3. The bogie according to claim 1, wherein each wheel set has an axle bearing device and the axles of the drive units of the wheel sets are suspended on the axle bearing device.

4. The bogie according to claim 1, wherein the drive unit for each wheel set includes a motor assembly comprising a motor and a gear case, at lease one brake device, each brake device being mounted directly on the motor assembly and acting on at least one wheel disc of the associated wheel set.

5. The bogie according to claim 4, wherein the brake device is mounted on the motor assembly by a retaining device.

6. The bogie according to claim 4, wherein the brake device is a brake-block device.

7. The bogie according to claim 4, wherein the brake device is a wheel-disc brake device.

8. A bogie having three wheel sets for supporting a rail vehicle comprising: a bogie frame having a longitudinal axis, a center wheel set connected with the bogie frame, two end wheel sets connected with the bogie frame with the center wheel set being positioned between the end wheel sets, each wheel set including an axle and wheels mounted on the axle and a drive unit for the axle, each end wheel set being connected with the bogie frame by a pair of slanted links extending between the bogie frame and the drive unit, the center wheel set being connected with the bogie frame by at least one longitudinal link extending longitudinally of the bogie frame between the bogie frame and the drive unit, the drive unit of one of the end wheel sets being connected with the drive unit of the center wheel set by a first transverse link and the drive unit of the center wheel set being connected with the drive unit of the other end wheel set by a second transverse link, whereby the wheel sets are coupled with each other so that during the transverse movement of the center wheel set, the end wheel sets are coupled in opposite directions during a turn out movement of the end wheel sets.

9. The bogie according to claim 8, further comprising link mountings having multiple-degrees of freedom, and wherein the transverse links are connected with the respective drive units and wheel sets by the link mountings.

10. The bogie according to claim 8 wherein the slanted links are mounted in a trapezoidal arrangement.

* * * * *